US012178247B2

(12) United States Patent
Sayed et al.

(10) Patent No.: US 12,178,247 B2
(45) Date of Patent: Dec. 31, 2024

(54) AEROSOL PROVISION DEVICE

(71) Applicant: NICOVENTURES TRADING LIMITED, London (GB)

(72) Inventors: Ashley John Sayed, London (GB); Mitchel Thorsen, Madison, WI (US); Luke James Warren, London (GB)

(73) Assignee: NICOVENTURES TRADING LIMITED, London (GB)

( * ) Notice: Subject to any disclaimer, the term of this patent is extended or adjusted under 35 U.S.C. 154(b) by 359 days.

(21) Appl. No.: 17/593,134

(22) PCT Filed: Mar. 9, 2020

(86) PCT No.: PCT/EP2020/056247
§ 371 (c)(1),
(2) Date: Sep. 10, 2021

(87) PCT Pub. No.: WO2020/182755
PCT Pub. Date: Sep. 17, 2020

(65) Prior Publication Data

US 2022/0183357 A1 Jun. 16, 2022

Related U.S. Application Data

(60) Provisional application No. 62/816,265, filed on Mar. 11, 2019.

(51) Int. Cl.
*A24F 40/42* (2020.01)
*A24F 40/20* (2020.01)
(Continued)

(52) U.S. Cl.
CPC ..... *A24F 40/42* (2020.01); *A24F 40/20* (2020.01); *A24F 40/465* (2020.01); *A24F 40/60* (2020.01)

(58) Field of Classification Search
CPC ..... A24F 40/42; A24F 40/465; A24F 40/20; A24F 40/60
(Continued)

(56) References Cited

U.S. PATENT DOCUMENTS 2,558,607 A * 6/1951 Dallenbach ..... F23Q 2/06 431/276
8,910,783 B2 * 12/2014 Liu ..... A24F 15/12 220/829
(Continued)

FOREIGN PATENT DOCUMENTS

CN 2899398 Y 5/2007
CN 201243425 Y 5/2009
(Continued)

OTHER PUBLICATIONS

International Search Report for PCT/EP2020/056247 dated May 29, 2020 (3 pages).
(Continued)

*Primary Examiner* — Peter G Leigh
(74) *Attorney, Agent, or Firm* — WOMBLE BOND DICKINSON (US) LLP

(57) ABSTRACT

An aerosol provision device includes a spring, wherein a first end of the spring is connected to the lid at a first pivot point and the first end is rotatable about the first pivot point as the lid moves between the open and closed positions. A second end of the spring is connected to the housing at a second pivot point and the second end is rotatable about the second pivot point as the lid moves between the open and closed positions. The spring is configured such that the spring biases the lid towards the open position when the lid is between the open position and the intermediate position,
(Continued)

and the spring biases the lid towards the closed position when the lid is between the intermediate position and the closed position.

12 Claims, 9 Drawing Sheets

(51) Int. Cl.
*A24F 40/465* (2020.01)
*A24F 40/60* (2020.01)

(58) Field of Classification Search
USPC ..... 131/329
See application file for complete search history.

(56) References Cited

U.S. PATENT DOCUMENTS

| | | | | |
|---|---|---|---|---|
| 9,415,929 | B2 * | 8/2016 | Liu | A24F 15/01 |
| 2011/0100993 | A1 | 5/2011 | Wu | |
| 2014/0216961 | A1 * | 8/2014 | Liu | A24F 15/01 206/266 |
| 2015/0041482 | A1 * | 2/2015 | Liu | B65D 85/20 220/847 |
| 2017/0150757 | A1 * | 6/2017 | Worm | H05B 1/0244 |
| 2017/0196264 | A1 | 7/2017 | Liu | |
| 2018/0160741 | A1 * | 6/2018 | Worm | A24F 15/01 |

FOREIGN PATENT DOCUMENTS

| | | | | |
|---|---|---|---|---|
| CN | 201753739 U | | 3/2011 | |
| CN | 202792099 U | | 3/2013 | |
| CN | 203416809 U | * | 2/2014 | A24F 15/12 |
| CN | 207383538 U | | 5/2018 | |
| EP | 3031338 A1 | * | 6/2016 | A24F 15/12 |
| EP | 3182845 B1 | * | 6/2018 | A24B 15/167 |
| JP | 2016511724 A | | 4/2016 | |
| JP | 2019180393 A | | 10/2019 | |
| KR | 10-2009-0112572 A | | 10/2009 | |
| WO | 2014195687 A1 | | 12/2014 | |
| WO | WO-2015003394 A1 | * | 1/2015 | A24F 15/12 |
| WO | WO-2015018041 A1 | * | 2/2015 | A24F 15/12 |
| WO | 2016023175 A1 | | 2/2016 | |
| WO | 2016207407 A1 | | 12/2016 | |
| WO | 2017194762 A1 | | 11/2017 | |
| WO | 2019188782 A1 | | 10/2019 | |
| WO | 2020182755 A1 | | 9/2020 | |

OTHER PUBLICATIONS

Photograph of a device Ploom S (model: PS1) having the serial No. 010210009255.

Press release dated Jan. 17, 2019 announcing that Japan Tobacco Inc. launches the Ploom S to be rolled out in the online store and Ploom shops from Jan. 29, 201g._ D6.1 is available online via the URL: https://www.iti.com/sites/default/fi les/press-releases/documents/2019/JTlaunches-two-new-tobacco-vapor-products-under-its-ploom-brand 0.pdf.

Youtube video https://www.youtube.com/watch?v=5Ayv XKOZXM published on Jan. 29, 2019 and displaying a device Ploom S (model: PS1); and screenshots.

Wikipedia Article "Plain bearing" related to bushing in the version of Jan. 17, 2019.

Excerpt of Opposition to European Patent No. 3 937 687 (20714864.4) dated Sep. 25, 2024.

Excerpt of Opposition to European Patent No. 3 937 687 (20714864.4) dated Sep. 26, 2024.

Excerpt of Opposition to European Patent No. 3 937 687 (20714864.4) dated Sep. 27, 2024.

Publication of U.S. Appl. No. 62/816,265 dated Mar. 30, 2020.

* cited by examiner

AEROSOL PROVISION DEVICE

The present application is a National Phase entry of PCT Application No. PCT/EP2020/056247, filed Mar. 9, 2020, which claims priority from U.S. Provisional Application No. 62/816,265, filed Mar. 11, 2019, each of which is hereby fully incorporated herein by reference.

TECHNICAL FIELD

The present invention relates to an aerosol provision device.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

According to a first aspect of the present disclosure, there is provided an aerosol provision device. The device includes a housing delimiting an opening at one end, the opening being configured to receive aerosol generating material therein; a lid moveable from an open position where the opening is exposed, to a closed position where the opening is covered, via an intermediate position; and a spring. A first end of the spring is connected to the lid at a first pivot point and the first end is rotatable about the first pivot point as the lid moves between the open and closed positions; a second end of the spring is connected to the housing at a second pivot point and the second end is rotatable about the second pivot point as the lid moves between the open and closed positions. The spring is configured such that: the spring biases the lid towards the open position when the lid is between the open position and the intermediate position; and the spring biases the lid towards the closed position when the lid is between the intermediate position and the closed position.

Further features and advantages of the invention will become apparent from the following description of preferred embodiments of the invention, given by way of example only, which is made with reference to the accompanying drawings.

DETAILED DESCRIPTION OF THE DRAWINGS

Figure 1:
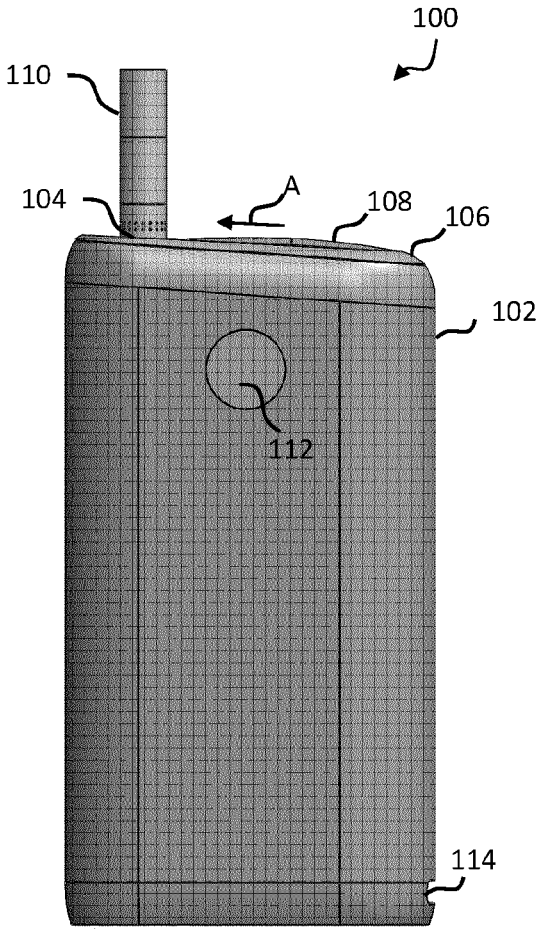
FIG. 1 shows a front view of an example of an aerosol provision device.

As used herein, the term "aerosol generating material" includes materials that provide volatilized components upon heating, typically in the form of an aerosol. Aerosol generating material includes any tobacco-containing material and may, for example, include one or more of tobacco, tobacco derivatives, expanded tobacco, reconstituted tobacco or tobacco substitutes. Aerosol generating material also may include other, non-tobacco, products, which, depending on the product, may or may not contain nicotine. Aerosol generating material may for example be in the form of a solid, a liquid, a gel, a wax or the like. Aerosol generating material may for example also be a combination or a blend of materials. Aerosol generating material may also be known as "smokable material."

Apparatuses are known that heat aerosol generating material to volatilize at least one component of the aerosol generating material, typically to form an aerosol which can be inhaled, without burning or combusting the aerosol generating material. Such an apparatus is sometimes described as an "aerosol generating device," an "aerosol provision device," a "heat-not-burn device," a "heat-not-burn device," a "tobacco heating product device," or a "tobacco heating device" or similar. Similarly, there are also so-called e-cigarette devices, which typically vaporize an aerosol generating material in the form of a liquid, which may or may not contain nicotine. The aerosol generating material may be in the form of or be provided as part of a rod, cartridge or cassette or the like which can be inserted into the apparatus. A heater for heating and volatilizing the aerosol generating material may be provided as a "permanent" part of the apparatus.

An aerosol provision device can receive an article comprising aerosol generating material for heating. An "article" in this context is a component that includes or contains in use the aerosol generating material, which is heated to volatilize the aerosol generating material, and optionally other components in use. A user may insert the article into the aerosol provision device before it is heated to produce an aerosol, which the user subsequently inhales. The article may be, for example, of a predetermined or specific size that is configured to be placed within a heating chamber of the device which is sized to receive the article.

A first aspect of the present disclosure defines an aerosol provision device comprising a moveable lid (also known as a lid assembly) and a spring. The spring can be anchored to a housing of the device at one end of the spring and can be anchored to the lid at another end of the spring. The housing defines an opening through which a user can insert and remove aerosol generating material. The lid can be moved from an open position (in which the opening is not covered by the lid) to a closed position (in which the opening is covered by the lid). When the lid is moved, by a user or other mechanism, the spring moves between being more compressed and more relaxed. When the lid is moved, the spring can rotate relative to the lid and the housing. For example, the spring can rotate about the point at which it is connected to the lid and can rotate about the point at which it is connected to the housing. The spring may bias the lid towards an open position, and as the lid is moved towards an intermediate position the spring can become more compressed. At the intermediate position the spring may be in its most compressed state. Moving the lid beyond this point causes the spring to rotate to a position which allows the spring to relax, which then biases the lid towards the closed position. Thus, as the lid moves beyond the intermediate position the spring re-orientates. The mechanism therefore allows the spring to bias the lid towards the closed position and the open position through this rotation caused by the movement of the lid.

It has been found that this mechanism requires a lower force to operate when compared to existing mechanisms. This is achieved because the mechanism experiences low frictional forces due to the relatively few moving parts. Furthermore, by having relatively few moving parts, the mechanism is more reliable and less prone to failure.

Accordingly, the first aspect defines an aerosol provision device comprising a housing delimiting an opening at one end, where the opening is configured to receive aerosol generating material therein, and a lid that is moveable along from an open position where the opening is exposed, to a closed position where the opening is covered, via an intermediate position. The device further comprises a spring, wherein a first end of the spring is connected to the lid at a first pivot point and the first end is rotatable about the first pivot point as the lid moves between the open and closed positions, for example along the guide rail. A second end of the spring is connected to the housing at a second pivot point and the second end is rotatable about the second pivot point as the lid moves between the open and closed positions, for example along the guide rail. The spring is configured such that the spring biases the lid towards the open position when the lid is between the open position and the intermediate position, and the spring biases the lid towards the closed position when the lid is between the intermediate position and the closed position.

In some examples, the device comprises a guide rail, and the guide rail may define an axis, and the lid moves in a direction parallel to the axis. The first pivot point may be offset from the second pivot point in a direction perpendicular to the axis. In some examples there are two guide rails arranged parallel to each other. The lid may comprise one or more guide rail mounting assemblies for connecting the lid to the one or more guide rails. In a particular example the housing comprises two elongated cavities which define the two guide rails. The lid may comprise two projecting members which define the guide rail mounting assemblies. The projecting members are to be received in the elongated cavities and move along the length of the elongated cavities as the lid is moved alone the guide rails.

The first pivot point can move with the lid.

The spring may comprise a metal or alloy, such as steel.

The spring may be a compression spring. The spring may be configured such that it is compressed as the lid is moved from the open position to the intermediate position and is compressed as the lid is moved from the closed position to the intermediate position. Thus, the spring becomes compressed as it is moved between these positions in this direction. The spring may be configured such that it relaxes as the lid is moved from the intermediate position to the open position (thereby biasing towards the open position) and relaxes as the lid is moved from the intermediate position to the closed position.

The spring may comprise a length of wire comprising a series of loops along its length, and wherein the sizes of the loops increase as the spring is compressed. Such a spring has a low profile which makes the mechanism more compact. In some examples the loops are substantially circular in shape. The loops may be clothoid loops. When the spring is in a relaxed state the series of loops do not fully overlap (i.e. they are not arranged coaxially). When the spring becomes more compressed, the loops may move closer together but may not be coaxial.

In alternative examples, the spring may be a zig zag spring or may have a generally serpentine shape.

In some examples, the spring has a spring constant of between about 63 and about 189 N/m. It has been found that a spring constant within this range allows for easy, smooth operation and a pleasant tactile feel to the mechanism.

The device may have a first protruding assembly defining the first pivot point and a second protruding assembly defining the second pivot point. The first protruding assembly may be fixed in place relative to the lid and extend towards the housing and the second protruding assembly may be fixed in place relative to the housing and extend towards the lid. The protruding assemblies therefore provide rotation axes about which the spring can rotate. The spring therefore extends between the first and second protruding assemblies.

The device may comprise a first bushing associated with the first protruding assembly, wherein the first bushing rotates relative to the lid and a second bushing associated with the second protruding assembly, wherein the second bushing rotates relative to the housing. The first and second bushings are preferably cylindrical. The bushings can rotate and experience less frictional forces when compared to a spring which is in direct contact with an axle. The ends of the spring may be fixed (rotationally) with respect to the first and second bushings. Thus, as the spring rotates, the bushing rotates.

The first and second bushings may rotate relative to respective axles. In one example, only the first bushing rotates relative to an axle. The housing may comprise a receptacle and the second bushing may be disposed within the receptacle. This allows the bushing to rotate within the receptacle. In some examples however the second bushing may rotate about an axle which is disposed within the receptacle. The receptacle allows the second end of the spring to be connected to the housing without additional connector components, which may be liable to failure. The receptacle can also allow the second bushing to rotate while experiencing low frictional forces. The receptacle may be located on the housing such that the lid moves over the receptacle as it is moved between the open and closed positions.

The housing may define a recess and the lid may be at least partially disposed within the recess. The lid can therefore be protected by the recess. For example, the lid is less likely to experience impact forces which cause the lid to break or disconnect from the housing.

In an example, the recess comprises a cavity disposed within an inner wall. The cavity can define a guide rail and the lid is configured to engage the guide rail. By having a guide rail in the form of a cavity (rather than a raised rail, for example), the overall mechanism can have a lower profile. The cavity also means that fewer parts are required, which makes the device lighter and cheaper to manufacture. There are also fewer parts which are prone to failure.

The second pivot point may be positioned closer to the closed position than the open position, such that the spring exerts a greater force in the closed position than in the open position. This helps to ensure the lid stays closed. In other words, the top surface of the housing may have a length between a first end and a second end, where the opening is arranged towards the second end, and the second pivot point may be displaced from a midpoint of the top surface closer towards the second end.

In a particular arrangement the top surface of the housing is about 40 mm in length, and the second pivot point is displaced towards the opening by between about 5 mm and about 10 mm from the midpoint. In a particular example the second pivot point is displaced towards the opening by about 7 mm, and is therefore about 13 mm from the second end of the housing. The spring may be more compressed when the lid is in the closed position than when the lid is in the closed position.

FIG. 1 shows an example of an aerosol provision device 100 for generating aerosol from an aerosol generating medium/material. In broad outline, the device 100 may be used to heat a replaceable article 110 comprising the aerosol generating medium, to generate an aerosol or other inhalable medium which is inhaled by a user of the device 100.

The device 100 comprises a housing 102 (at least partially defined by an outer cover) which surrounds and houses various components of the device 100. The device 100 has an opening 104 in one end of the housing 102, through which the article 110 may be inserted for heating by a heating assembly. In use, the article 110 may be fully or partially inserted into the heating assembly where it may be heated by one or more components of the heater assembly.

The device 100 of this example comprises a first end member 106 which comprises a lid 108 which is moveable relative to the first end member 106 to close the opening 104 when no article 110 is in place. In FIG. 1, the lid 108 is shown in an open configuration, however the lid 108 may move into a closed configuration. For example, a user may cause the lid 108 to slide in the direction of arrow "A".

The device 100 may also include a user-operable control element 112, such as a button or switch, which operates the device 100 when pressed. For example, a user may turn on the device 100 by operating the switch 112.

The device 100 may also comprise an electrical connector/component, such as a socket/port 114, which can receive a cable to charge a battery of the device 100. For example, the socket 114 may be a charging port, such as a USB charging port. In some examples the socket 114 may be used additionally or alternatively to transfer data between the device 100 and another device, such as a computing device.

Figure 2:
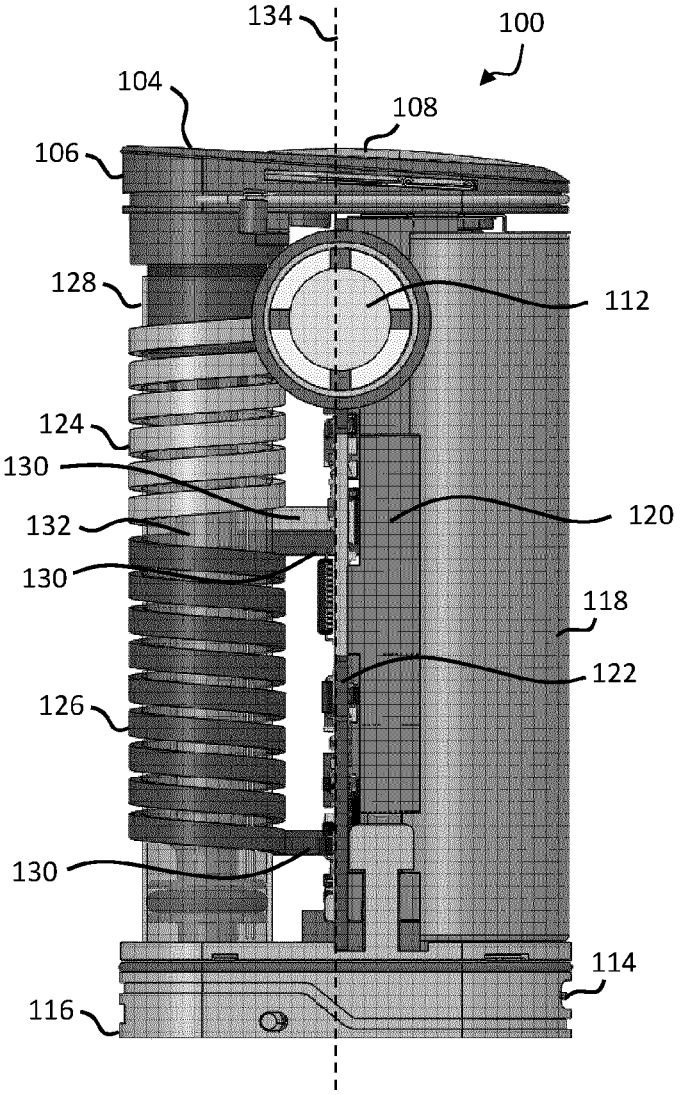
FIG. 2 shows a front view of the aerosol provision device of FIG. 1 with an outer cover removed.

FIG. 2 depicts the device 100 of FIG. 1 with the outer cover 102 removed and without an article 110 present. The device 100 defines a longitudinal axis 134.

As shown in FIG. 2, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 110 into the opening 104, operates the user control 112 to begin heating the aerosol generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. Examples of suitable batteries include, for example, a lithium battery (such as a lithium-ion battery), a nickel battery (such as a nickel-cadmium battery), and an alkaline battery. The battery is electrically coupled to the heating assembly to supply electrical power when required and under control of a controller (not shown) to heat the aerosol generating material. In this example, the battery is connected to a central support 120 which holds the battery 118 in place. The central support 120 may also be known as a battery support, or battery carrier.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 110 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element, and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from Litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper Litz wire which has a rectangular cross section. In other examples the Litz wire can have other shape cross sections, such as circular.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction along the longitudinal axis 134 of the device 100 (that is, the first and second inductor coils 124, 126 to not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 2, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

In this example, the first inductor coil 124 and the second inductor coil 126 are wound in opposite directions. This can be useful when the inductor coils are active at different times. For example, initially, the first inductor coil 124 may be operating to heat a first section of the article 110, and at a later time, the second inductor coil 126 may be operating to heat a second section of the article 110. Winding the coils in opposite directions helps reduce the current induced in the inactive coil when used in conjunction with a particular type of control circuit. In FIG. 2, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a receptacle within which aerosol generating material is received. For example, the article 110 can be inserted into the susceptor 132. In this example the susceptor 120 is tubular, with a circular cross section.

The device 100 of FIG. 2 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 2, the first and second inductor coils 124, 126 are positioned around the insulating member 128 and are in contact with a radially outward surface of the insulating member 128. In some examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 3:
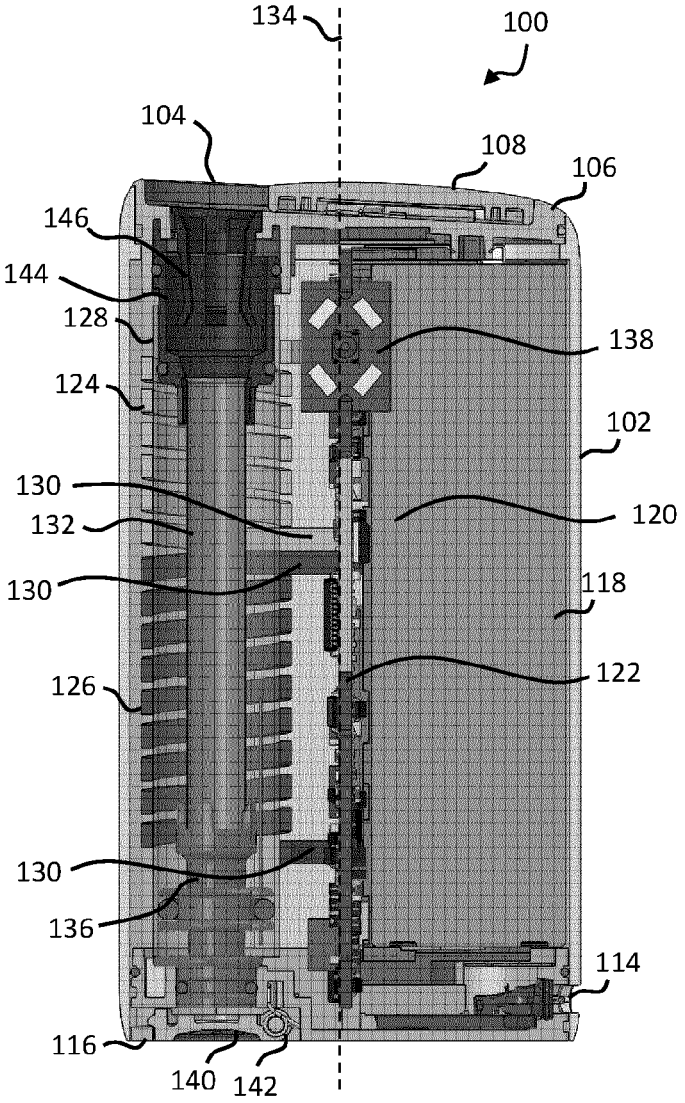
FIG. 3 shows a cross-sectional view of the aerosol provision device of FIG. 1.

FIG. 3 shows a side view of device 100 in partial cross-section. The outer cover 102 is present in this example. The rectangular cross-sectional shape of the first and second inductor coils 124, 126 is more clearly visible.

The device 100 further comprises a support 136 which engages one end of the susceptor 132 to hold the susceptor 132 in place. The support 136 is connected to the second end member 116.

The device may also comprise a second printed circuit board 138 associated within the control element 112.

The device 100 further comprises a second lid/cap 140 and a spring 142, arranged towards the distal end of the device 100. The spring 142 allows the second lid 140 to be opened, to provide access to the susceptor 132. A user may open the second lid 140 to clean the susceptor 132 and/or the support 136.

The device 100 further comprises an expansion chamber 144 which extends away from a proximal end of the susceptor 132 towards the opening 104 of the device. Located at least partially within the expansion chamber 144 is a retention clip 146 to abut and hold the article 110 when received within the device 100. The expansion chamber 144 is connected to the end member 106.

Figure 4:
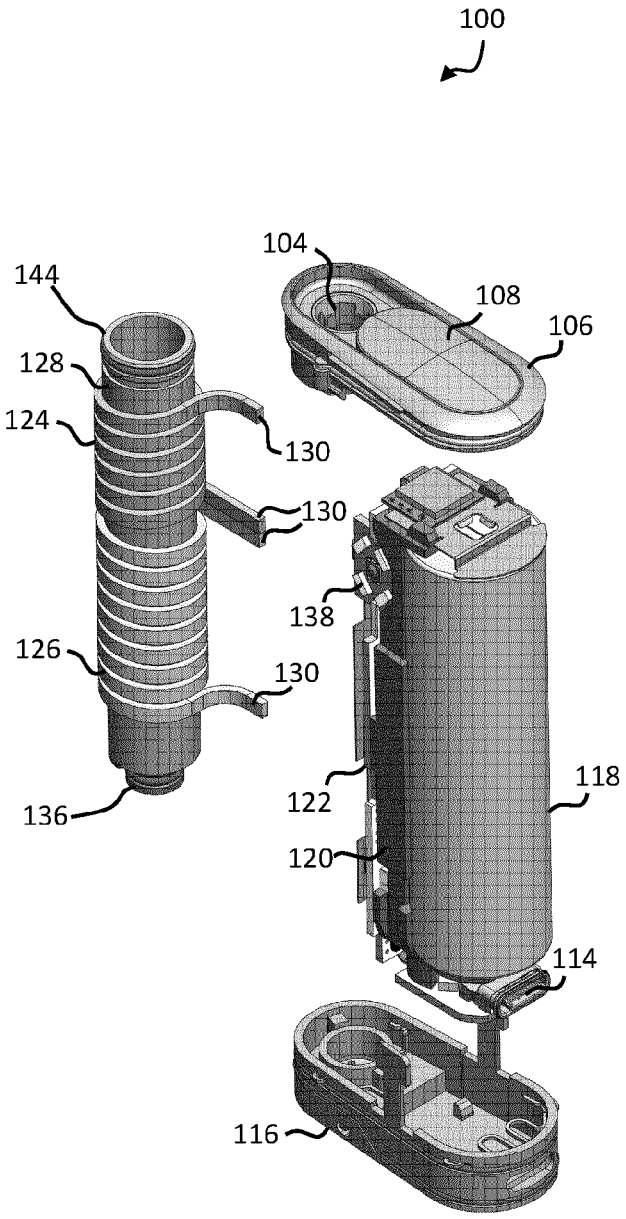
FIG. 4 shows an exploded view of the aerosol provision device of FIG. 2.

FIG. 4 is an exploded view of the device 100 of FIG. 1, with the outer cover 102 omitted.

Figure 5A:
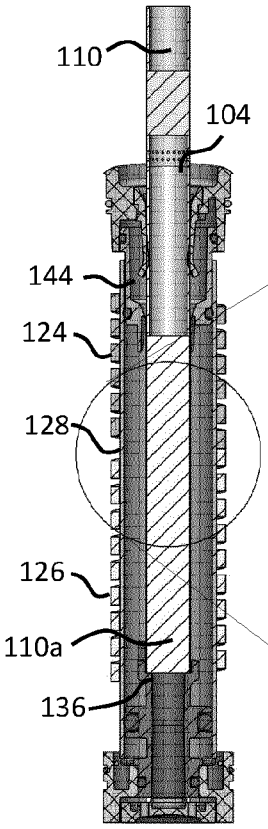
FIG. 5A shows a cross-sectional view of a heating assembly within an aerosol provision device.
Figure 5B:
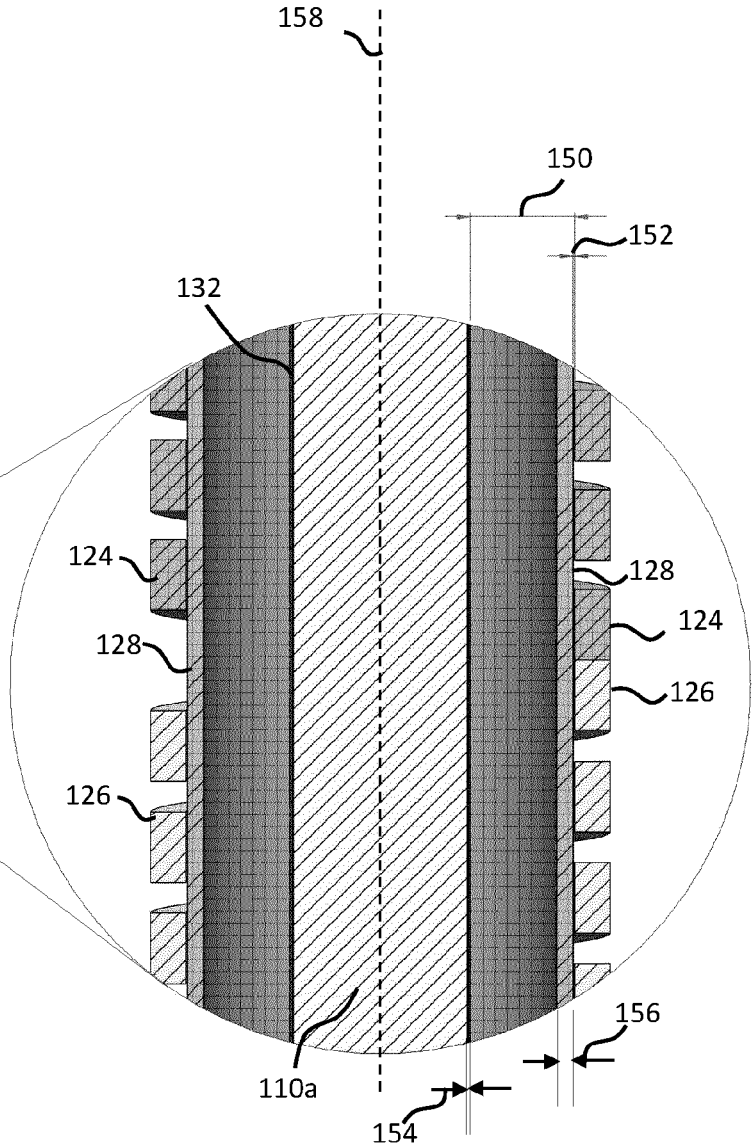
FIG. 5B shows a close-up view of a portion of the heating assembly of FIG. 5A.

FIG. 5A depicts a cross section of a portion of the device 100 of FIG. 1. FIG. 5B depicts a close-up of a region of FIG. 5A. FIGS. 5A and 5B show the article 110 received within the susceptor 132, where the article 110 is dimensioned so that the outer surface of the article 110 abuts the inner surface of the susceptor 132. This ensures that the heating is most efficient. The article 110 of this example comprises aerosol generating material 110*a*. The aerosol generating material 110*a* is positioned within the susceptor 132. The article 110 may also comprise other components such as a filter, wrapping materials and/or a cooling structure. FIG. 5B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3 mm to 3.5 mm, or about 3.25 mm.

FIG. 5B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40 mm to 45 mm, or about 44.5 mm.

In one example, the insulating member 128 has a wall thickness 156 of about 0.25 mm to 2 mm, about 0.25 mm to 1 mm, or about 0.5 mm.

Figure 6:
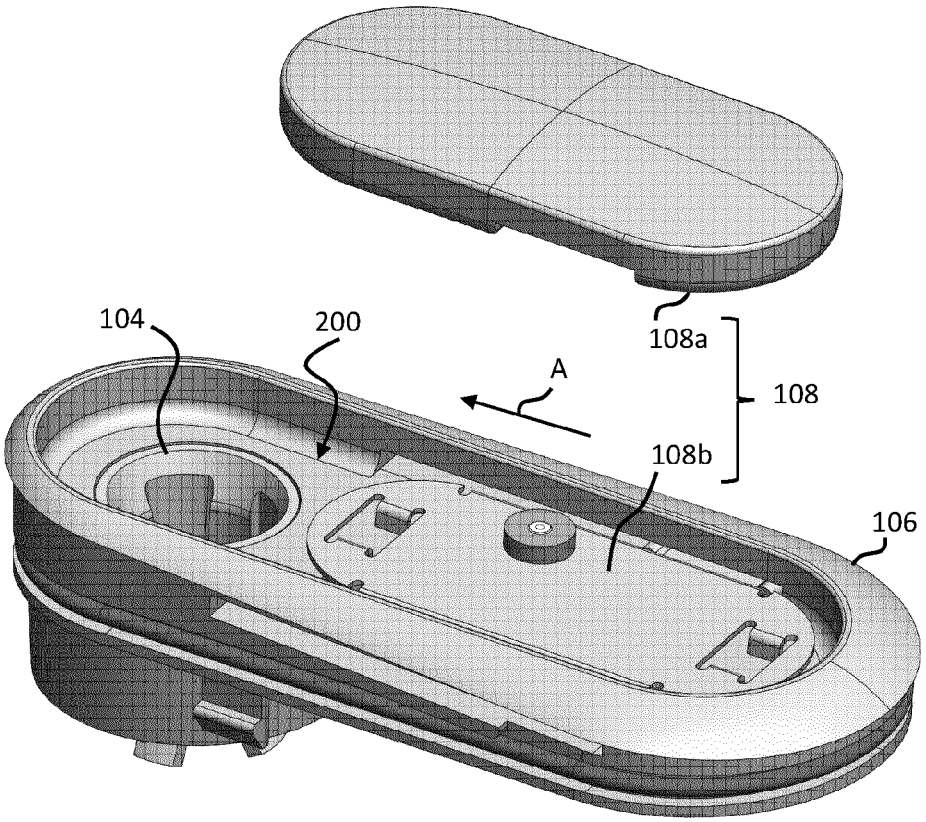
FIG. 6 shows an exploded diagram of a lid mechanism of the device.

FIG. 6 depicts an exploded diagram of a top portion of the device 100. As briefly mentioned, FIG. 6 shows the first end member 106 and the opening 104 in which aerosol generating material can be received. The first end member 106 can form part of the housing 102 of the device 100. In this example, the lid 108 (also known as a lid assembly) comprises at least a first portion 108*a* and a second portion 108*b*. The first portion 108*a* is connected to and at least partially covers the second portion 108*b*. The first and second portions 108*a*, 108*b* move together as a user moves the lid 108. In FIG. 6, the lid 108 is arranged in an open position in which opening 104 is fully exposed (i.e., the lid 108 does not cover the opening 104). If the lid 108 is moved in the direction of the arrow A, the lid can be moved to a closed position in which the opening 104 is covered. The lid 108 can move within a recess 200 defined by the first end member 106 or housing 102. The recess 200 can protect the lid 108 from being damaged.

Figure 7:
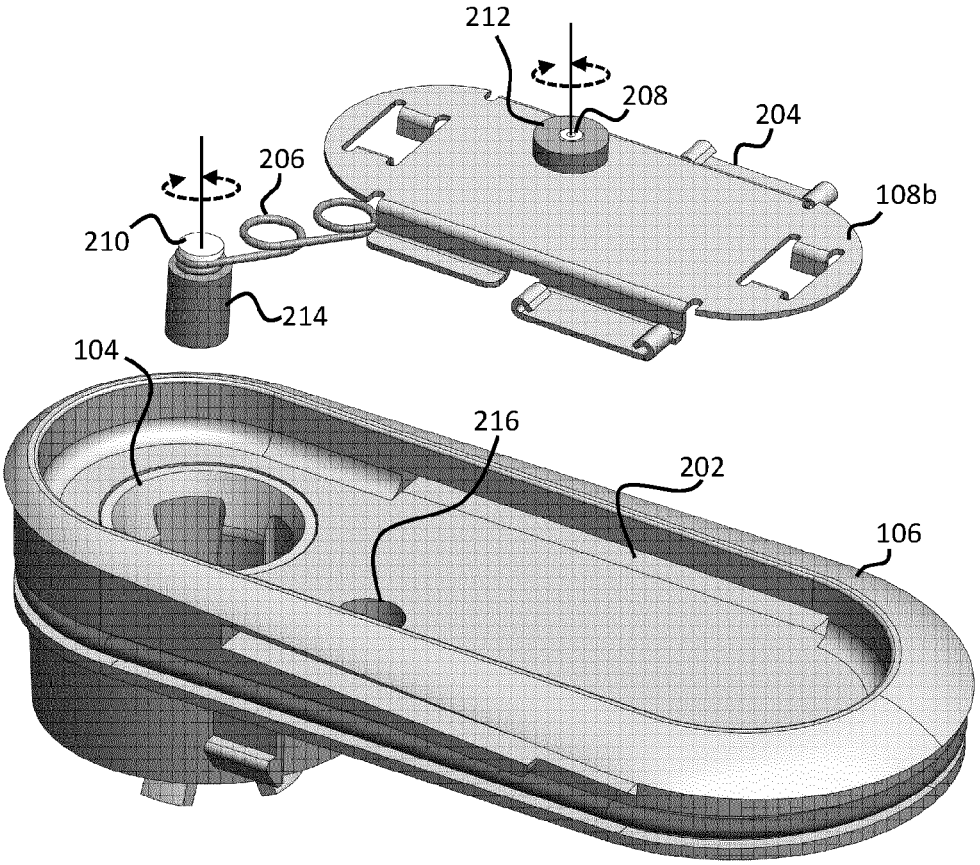
FIG. 7 shows another exploded diagram of the lid mechanism.

FIG. 7 depicts another exploded diagram of the top portion of the device 100. Here the second portion 108*b* of the lid 108 has been disconnected from the housing 102. An inner wall of the recess 200 comprises a guide rail 202 in the form of a cavity 202. An opposite inner wall of the recess 200 may comprise a second guide rail in the form of a second cavity. The second cavity is obscured from view in FIG. 7. The lid 108 (or more specifically the second portion 108*b*) may comprise one or more guide rail mounting assemblies 204 in the form of one or more projecting members 204 which are received within the one or more cavities 202. Each projecting member 204 moves within, and along the cavity 202 as the lid 108 is moved. The projecting member 204 also stops the lid 108 from disconnecting from the device 100.

FIG. 7 also shows a spring 206, such as a low-profile compression spring, which is connected at one end to a first pivot point 208 and which is connected at another end to a second pivot point 210. The first pivot point 208 is connected to the lid 108, and therefore moves with the lid 108. In this example the first pivot point 208 comprises a first protruding assembly in the form of a first bushing 212 which rotates relative to the lid about a rotational axis. The first protruding assembly extends downwards from the lid 108 towards the housing 102 and the first end member 106. The second pivot point 210 of this example also comprises a second protruding assembly in the form of a second bushing 214 which can rotate relative to the housing 102 and first end member 106 about a rotational axis. The first protruding assembly extends upwards from the housing 102 and first end member 106 towards the lid 108. The second pivot point 210 is connectable to the housing 102. For example, the second bushing 212 can be received within a receptacle 216. The second bushing 212 can rotate within the receptacle 216.

Figure 8:
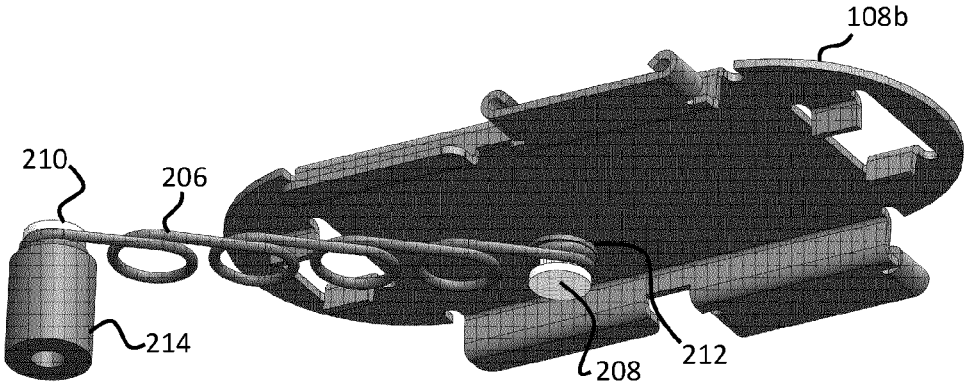
FIG. 8 shows a portion of the lid and a spring.

FIG. 8 depicts an underside of the second portion 108*b* of the lid 108. The first protruding assembly 212 is shown extending from the underside of the second portion 108*b*. The second bushing 214 may be slotted onto an axle/peg (not shown) which is contained within the receptacle 216. In other examples there is no axle and the second bushing 214 freely rotates within the receptacle 216.

FIG. 8 also more clearly shows the form of the compression spring 206. The spring 206 comprises a length of wire comprising a series of loops along its length. The spring 206 may be configured such that the sizes of the loops increase as the spring 206 is compressed. For example, the area within each loop increases in size. Increasing the size of each loop means that the loops get closer together as the spring 206 is compressed. If the spring 206 is compressed enough, some of the loops may even overlap. The spring 206 can also bend as the lid 108 is moved along the guide rail 202. FIG. 8 shows the spring 206 in a non-compressed (i.e., relaxed) state.

In other examples, the spring 206 may have a different form. For example, the spring may have a zig-zag or serpentine shape.

FIGS. 9A-9E show diagrammatic illustrations of the lid mechanism at various stages as the lid 108 is moved between an open position and a closed position.

Figure 9A:
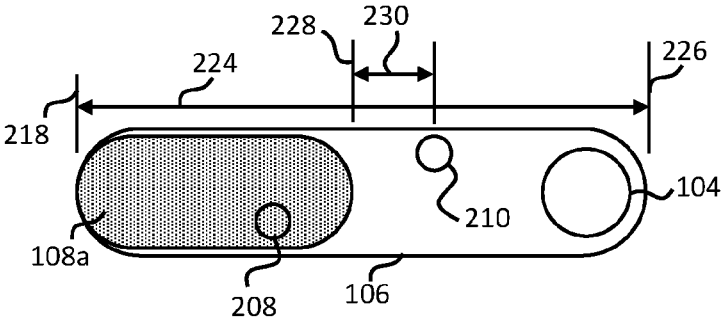
FIGS. 9A-9E show diagrammatic representations of the lid mechanism being opened and closed.

FIG. 9A shows the lid 108 in the open position. The opening 104 is exposed and the lid arranged towards a first end 218 of the top of the housing. In FIG. 9A the spring 206 is omitted to show the relative positions of the first and second pivot points 208, 210 more clearly.

Figure 9B:
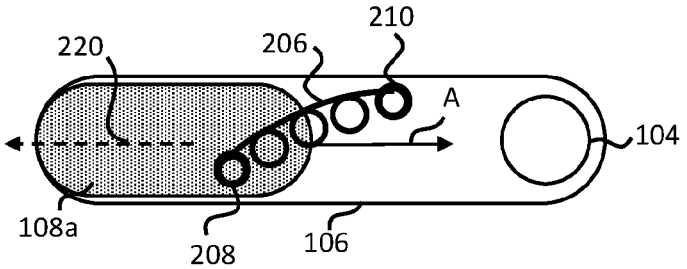

FIG. 9B shows the spring 206 connected to the lid 108 at the first pivot point 208 and the spring 206 connected to the housing at the second pivot point 210. The spring 206 may be in a fully relaxed state or may be slightly compressed. The lid 108 is still in the open position. Arrow 220 shows the direction of the biasing force provided by the spring 206. The spring 206 therefore biases the lid towards the open position. To move the lid in the direction of arrow A, a user would need to apply a force greater than the biasing force of the spring 206. As the lid 108 begins to move along the one or more guide rails the spring biases the lid towards the open position.

Figure 9C:
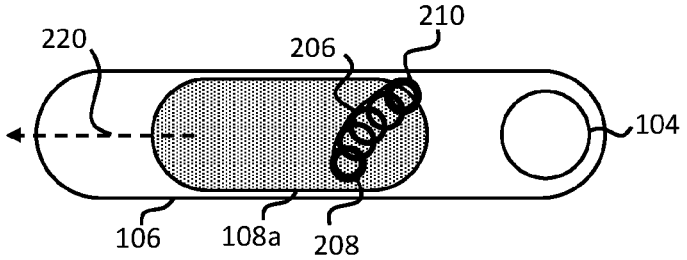

FIG. 9C shows the lid 108 at a later time. Here the spring 206 is in a more compressed state than in FIG. 9B. The loops within the spring 206 are larger and are closer together. The spring 206 may also be bent. As the lid 108 moves between the position shown in FIG. 9B and the position shown in FIG. 9C, the spring 206 has partially rotated about the two pivot points 208, 210. In FIG. 9C the lid 108 has not yet reached the intermediate position and is therefore still biased towards the open position, in the direction of arrow 220.

Figure 9D:
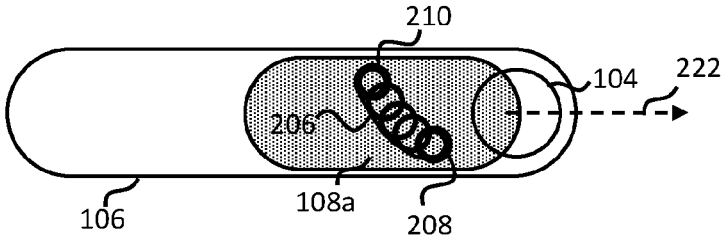

FIG. 9D shows the lid 108 at a later time. Here the lid 108 has moved beyond an intermediate position and the spring 206 has continued to rotate about the two pivot points 208, 210 to the extent that the first pivot point 208 has moved closer to the opening 104 than the second pivot point 210. The spring 206 therefore biases the lid 108 towards the closed position in the direction of arrow 222. The intermediate position is the boundary between the spring 206 biasing the lid 108 towards the open position and biasing the lid 108 towards the closed position. Depending upon the configuration and shape of the spring 206 this may be at the point where the first and second pivot points 208, 210 are aligned along an axis that is perpendicular to an axis defined by the guide rail (i.e., when the first and second pivot points 208, 210 are at the same distance from the opening 104). The intermediate position of the lid 108 is between the positions of the lid 108 shown in FIGS. 9C and 9D.

Figure 9E:
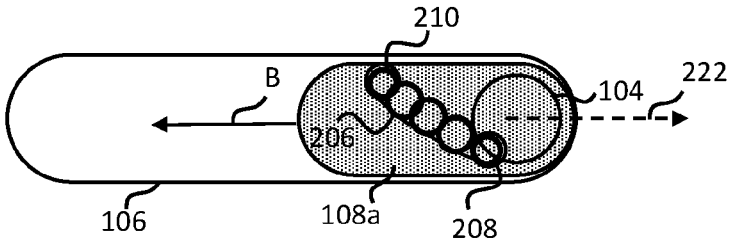

FIG. 9E shows the lid 108 in the closed position. The lid 108 therefore fully covers the opening 104. In this position, the spring 206 is in a less compressed state than in FIG. 9D. Arrow 222 shows the direction of the biasing force provided by the spring 206. The spring 206 therefore biases the lid towards the closed position. To open the lid 108, the user must move the lid 108 in the direction of arrow B.

FIG. 9A shows the top surface of the housing having a length 224 which is measured between the first end 218 of the top surface and a second end 226 of the top surface. The midpoint 228 of the top surface is halfway between the first and second ends 218, 226. The opening 104 is arranged towards the second end 226.

In some examples, the second pivot point 210 is positioned closer to the closed position than the open position. In other words, the second pivot point 210 is arranged closer to the second end 226 than the first end 218. The second pivot point is therefore displaced from the midpoint 228 of the top surface closer towards the second end 226. In a particular arrangement, the length 224 of the top surface of the housing is about 40 mm, and the second pivot point 210 is displaced towards the opening 104 (or second end) from the midpoint by a distance 330. In this example, the distance 330 is between about 5 mm and about 10 mm. For example, the distance 330 may be about 7 mm, and may therefore be positioned about 13 mm from the second end 226 of the housing. The spring 206 may therefore be more compressed when the lid 108 is in the closed position (shown in FIG. 9E) than when the lid 108 is in the closed position (shown in FIG. 9B).

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol provision device comprising:

a housing delimiting an opening at one end, the opening configured to receive aerosol generating material therein;

a lid moveable from an open position where the opening is exposed, to a closed position where the opening is covered, via an intermediate position; and a spring, wherein:

a first end of the spring is connected to the lid at a first pivot point and the first end is rotatable about the first pivot point as the lid moves between the open and closed positions;

a second end of the spring is connected to the housing at a second pivot point and the second end is configured to be rotatable about the second pivot point as the lid is moved between the open and closed positions;

and wherein the spring is configured such that:

the spring biases the lid towards the open position when the lid is between the open position and the intermediate position; and the spring biases the lid towards the closed position when the lid is between the intermediate position and the closed position.

2. An aerosol provision device according to claim 1, wherein the spring is a compression spring.

3. An aerosol provision device according to claim 1, wherein the spring is configured such that it is compressed:

as the lid is moved from the open position to the intermediate position; and as the lid is moved from the closed position to the intermediate position.

4. An aerosol provision device according to claim 1, wherein the spring comprises a length of wire having a series of loops along its length, and wherein the sizes of the loops are configured to increase as the spring is compressed.

5. An aerosol provision device according to claim 1, wherein the spring is a zig zag spring.

6. An aerosol provision device according to claim 1, comprising a first protruding assembly defining the first pivot point and a second protruding assembly defining the second pivot point, wherein:

the first protruding assembly is fixed in place relative to the lid and extends towards the housing; and the second protruding assembly is fixed in place relative to the housing and extends towards the lid.

7. An aerosol provision device according to claim 6, comprising:

a first bushing associated with the first protruding assembly, wherein the first bushing rotates relative to the lid; and a second bushing associated with the second protruding assembly, wherein the second bushing rotates relative to the housing.

8. An aerosol provision device according to claim 7, wherein the housing comprises a receptacle and the second bushing is disposed within the receptacle.

9. An aerosol provision device according to claim 1, wherein the housing defines a recess and the lid is at least partially disposed within the recess.

10. An aerosol provision device according to claim 9, wherein the recess comprises a cavity disposed within an inner wall which defines a guide rail and the lid is configured to engage the guide rail.

11. An aerosol provision device according to claim 1, wherein the second pivot point is positioned closer to the closed position than the open position, such that the spring exerts a greater force in the closed position than in the open position.

12. An aerosol provision system, comprising:

an aerosol provision device according to claim 1; and an article comprising aerosol generating material.

* * * * *